US012685919B2

(12) United States Patent
Leatherman et al.

(10) Patent No.: US 12,685,919 B2
(45) Date of Patent: Jul. 21, 2026

(54) PICKLEBALL SCOREKEEPING DEVICE

(71) Applicant: PICKLETIME SPORTS, LLC, Milwaukie, OR (US)

(72) Inventors: Timothy S. Leatherman, Portland, OR (US); Markus J Bureker, Milwaukie, OR (US); Steven B. Berliner, Milwaukie, OR (US); Denise K. Myers, Milwaukie, OR (US)

(73) Assignee: PICKLETIME SPORTS, LLC, Milwaukie, OR (US)

( * ) Notice: Subject to any disclaimer, the term of this patent is extended or adjusted under 35 U.S.C. 154(b) by 6 days.

(21) Appl. No.: 18/824,453

(22) Filed: Sep. 4, 2024

(65) Prior Publication Data

US 2026/0061291 A1 Mar. 5, 2026

(51) Int. Cl.
*A63B 71/06* (2006.01)

(52) U.S. Cl.
CPC ..... *A63B 71/0672* (2013.01)

(58) Field of Classification Search
CPC ..... A63B 71/0669; A63B 71/0672; A63B 2071/0663; A63B 2071/0602
USPC ..... 235/1 B; 116/222, 223, 309, 318
See application file for complete search history.

(56) References Cited

U.S. PATENT DOCUMENTS

| | | | | |
|---|---|---|---|---|
| 3,730,131 | A * | 5/1973 | Izzo | A63B 71/0672 235/114 |
| 5,134,565 | A | 7/1992 | Herbertz | |
| 6,634,548 | B1 | 10/2003 | Bowman | |
| 7,773,461 | B1 | 8/2010 | Crosby, Sr. | |
| 10,159,889 | B2 | 12/2018 | Johnson | |
| 2002/0116319 | A1 | 8/2002 | Black | |
| 2007/0032893 | A1 | 2/2007 | Lowran | |
| 2025/0032888 | A1 * | 1/2025 | Eklund | A63B 71/0669 |

FOREIGN PATENT DOCUMENTS

DE 3038094 A1 5/1982

* cited by examiner

*Primary Examiner* — Suezu Ellis
(74) *Attorney, Agent, or Firm* — ALSTON & BIRD LLP

(57) ABSTRACT

An apparatus and method are provided that relate to a scorekeeping device, and more particularly, to a device for keeping track of scores, player positions, serving team, server, and server number for doubles pickleball. The method of scoring doubles pickleball includes: rotating a first scoring wheel within a housing to advance a score and player positions for a first doubles team; rotating a second scoring wheel within the housing to advance a score and player positions for a second doubles team; and concurrently displaying the score and the player positions for the first doubles team and the score and the player positions for the second doubles team, as well as rotating a dial for identifying the serving team, the server, and the server's number.

25 Claims, 16 Drawing Sheets

PICKLEBALL SCOREKEEPING DEVICE

TECHNOLOGICAL FIELD

Embodiments described herein generally relate to a scorekeeping device, and more particularly, to a device for keeping track of scores, player positions, serving team, server, and server number for doubles pickleball.

BACKGROUND

Pickleball is a sport growing quickly in popularity due to being accessible and having broad appeal across all age ranges. The lower space requirements and lower physical challenges relative to tennis make pickleball a popular sport in public parks and private clubs across the United States for players of all ages. Pickleball games are typically played to eleven points, win by two, with a person (or team in doubles) scoring only while they are serving. In doubles pickleball the score includes three parts. When a server calls out the score in doubles, the first number is the serving team's score, the second number is the receiving team's score, and the third part of the score indicates the server's number. It then become complicated and easily confused as to who is serving and whether the server is properly positioned and who is receiving and whether the receiver is properly positioned. When the serve transfers from one team to the other, it is known as a "side out" and the scoring system in pickleball is known as "side out" scoring.

BRIEF SUMMARY

Embodiments generally relate to a scorekeeping device, and more particularly, to a device for keeping track of scores, player positions, serving team, server, and the server's number for doubles pickleball. Embodiments described herein include a doubles pickleball scoring device including: a housing defining at least one aperture; a first scoring wheel disposed within the housing and rotatable about a first axis; and a second scoring wheel disposed within the housing and rotatable about the first axis; where a portion of the first scoring wheel and a portion of the second scoring wheel are displayed within the at least one aperture, where the portion of the first scoring wheel displayed within the at least one aperture includes an indication of a position and score of a first doubles team, where the portion of the second scoring wheel displayed within the at least one aperture includes an indication of a position and score of a second doubles team.

According to an example embodiment the first doubles team includes a first player and a second player, where the first scoring wheel includes a first identifier for the first player, and a second identifier for the second player, where the portion of the first scoring wheel displayed within the at least one aperture includes an indication of a relative position on a pickleball court of the first player and the second player. According to certain embodiments the second doubles team includes a third player and a fourth player, where the second scoring wheel includes a third identifier for the third player, and a fourth identifier for the fourth player, where the portion of the second scoring wheel displayed within the at least one aperture includes an indication of a relative position on a pickleball court of the third player and the fourth player.

According to certain embodiments the score of the first doubles team is indicated on the portion of the first scoring wheel displayed within the at least one aperture between the first identifier and the second identifier. According to certain embodiments the score of the second doubles team is indicated on the portion of the second scoring wheel displayed within the at least one aperture between the third identifier and the fourth identifier. The doubles pickleball scoring device of some embodiments further includes a wrist strap attached to the housing.

The doubles pickleball scoring device of some embodiments further includes a dial indicator, where the dial indicator is rotatable about the first axis, and where the dial indicator points to indicia on the housing identifying a serving player of the first doubles team or the second doubles team. According to some embodiments the indicia on the housing further identifies a server's number of the first doubles team or the second doubles team.

The housing of the doubles pickleball scoring device of some embodiments defines a first opening and a second opening, where a portion of a periphery of the first scoring wheel is accessible to a user through the first opening, where a portion of a periphery of the second scoring wheel is accessible to the user through the second opening.

According to some embodiments the portion of the periphery of the first scoring wheel defines a first gripping element, where the first scoring wheel is configured to advance in response to the user moving the first gripping element within the first opening, where the portion of the periphery of the second scoring wheel defines a second gripping element, where the second scoring wheel is configured to advance in response to the user moving the second gripping element within the second opening.

The housing of some embodiments includes a plurality of detents, where the first scoring wheel includes at least one raised element, where in response to the user moving the first gripping element within the first opening, the at least one raised element of the first scoring wheel is advanced from a first detent to a second detent. According to some embodiments the at least one raised element of the first scoring wheel at the first detent defines a location displaying the player position and score of the first doubles team in the at least one aperture, and where the at least one raised element of the first scoring wheel at the second detent defines a location displaying a next player position and score of the first doubles team in a scoring sequence in the at least one aperture.

The housing of some embodiments includes a second plurality of detents, where the second scoring wheel includes at least one raised element, where in response to the user moving the first gripping element within the second opening, the at least one raised element of the second scoring wheel is advanced from a first detent of the second plurality of detents to a second detent of the second plurality of detents. According to some embodiments the at least one raised element of the second scoring wheel at the first detent defines a location displaying the player position and score of the second doubles team in the at least one aperture, and where the at least one raised element of the second scoring wheel at the second detent defines a location displaying a next player position and score of the second doubles team in a scoring sequence in the at least one aperture.

Embodiments provided herein include a doubles pickleball scoring device including: a housing defining at least one aperture and a cavity; a first scoring wheel disposed within the cavity, where a portion of the first scoring wheel is visible through the at least one aperture; and a second scoring wheel disposed within the cavity, where a portion of the second scoring wheel is visible through the at least one aperture, where the portion of the first scoring wheel displayed within the at least one aperture comprises an indication of a position and score of a first doubles team, and where the portion of the second scoring wheel displayed within the at least one aperture comprises an indication of a position and score of a second doubles team.

According to some embodiments, in response to advancing the first scoring wheel, the position and the score of the first doubles team advance concurrently. According to certain embodiments, in response to advancing the second scoring wheel, the position and the score of the second doubles team advance concurrently. The doubles pickleball scoring device of some embodiments further includes indicia on an outside surface of the housing and a pointer, where the indicia reflect serving person and serving person's number of a player of the first doubles team and the second doubles team, where the pointer indicates a current serving person and the current serving person's number.

According to some embodiments the pointer includes a pointer wheel rotatable about a first axis. According to certain embodiments first scoring wheel is rotatable about a second axis and the second scoring wheel is rotatable about a third axis, where at least one of the first axis, the second axis, or the third axis is different from another of the first axis, the second axis, or the third axis. The doubles pickleball scoring device of some embodiments further includes a wrist strap attached to the housing.

According to some embodiments the first scoring wheel includes a sequence of characters, where the sequence of characters comprises a sequence of numbers from zero to at least nine, with a first character following each even number and a second character following each odd number. According to certain embodiments the second scoring wheel includes a second sequence of characters, wherein the second sequence of characters comprises a sequence of numbers from zero to at least nine, with the first character following each odd number and the second character following each even number.

Embodiments provided herein include a method of scoring doubles pickleball including: rotating a first scoring wheel within a housing to advance a score and player positions for a first doubles team; rotating a second scoring wheel within the housing to advance a score and player positions for a second doubles team; and concurrently displaying the score and the player positions for the first doubles team and the score and the player positions for the second doubles team.

The method of some embodiments further includes rotating a dial indicator on the housing to indicate a server of the first doubles team or the second doubles team. According to some embodiments the indicia on the housing further identifies a server's number of the first doubles team or the second doubles team.

BRIEF DESCRIPTION OF THE DRAWINGS

Figure 1:
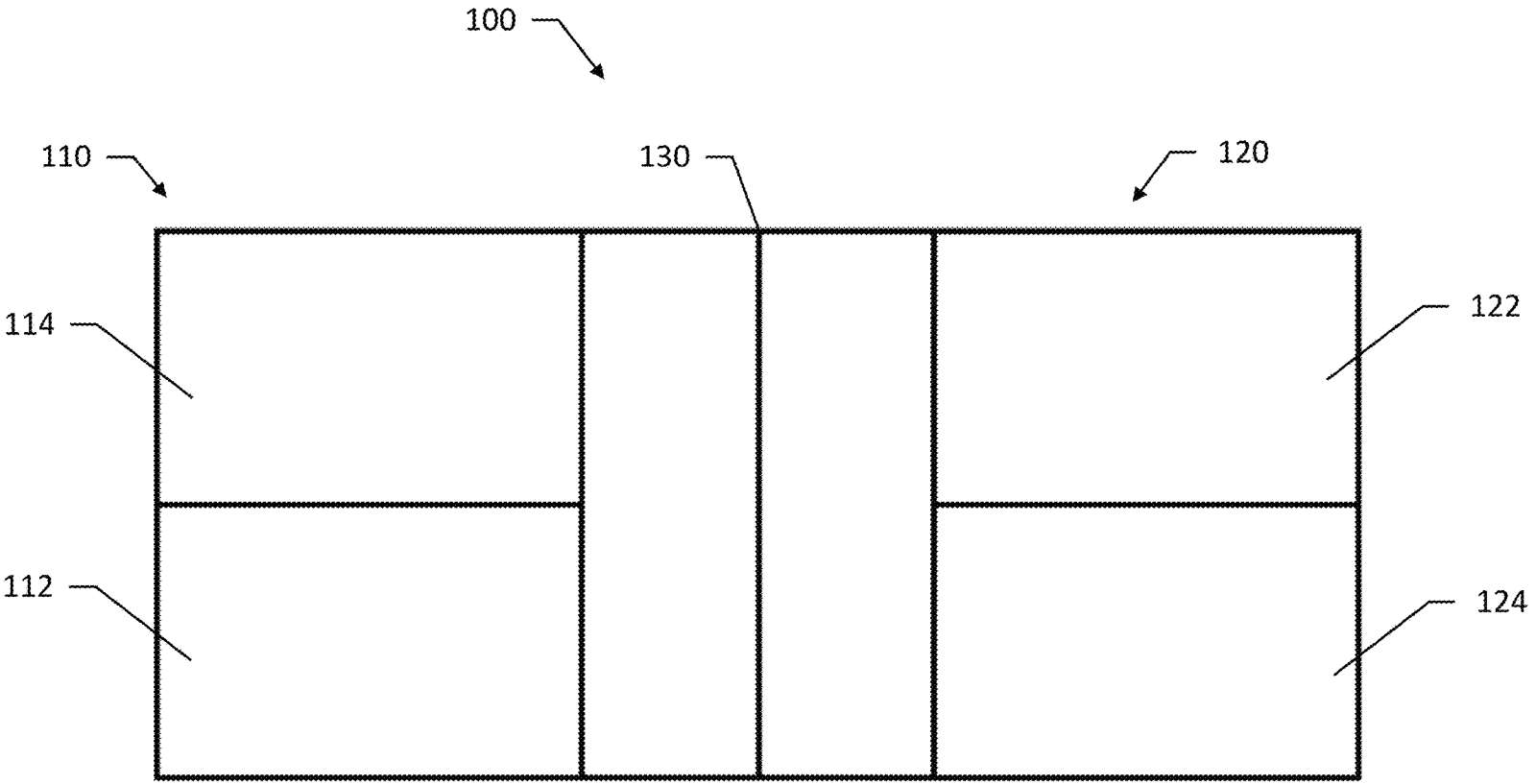
FIG. 1 (PRIOR ART)
Figure 2:
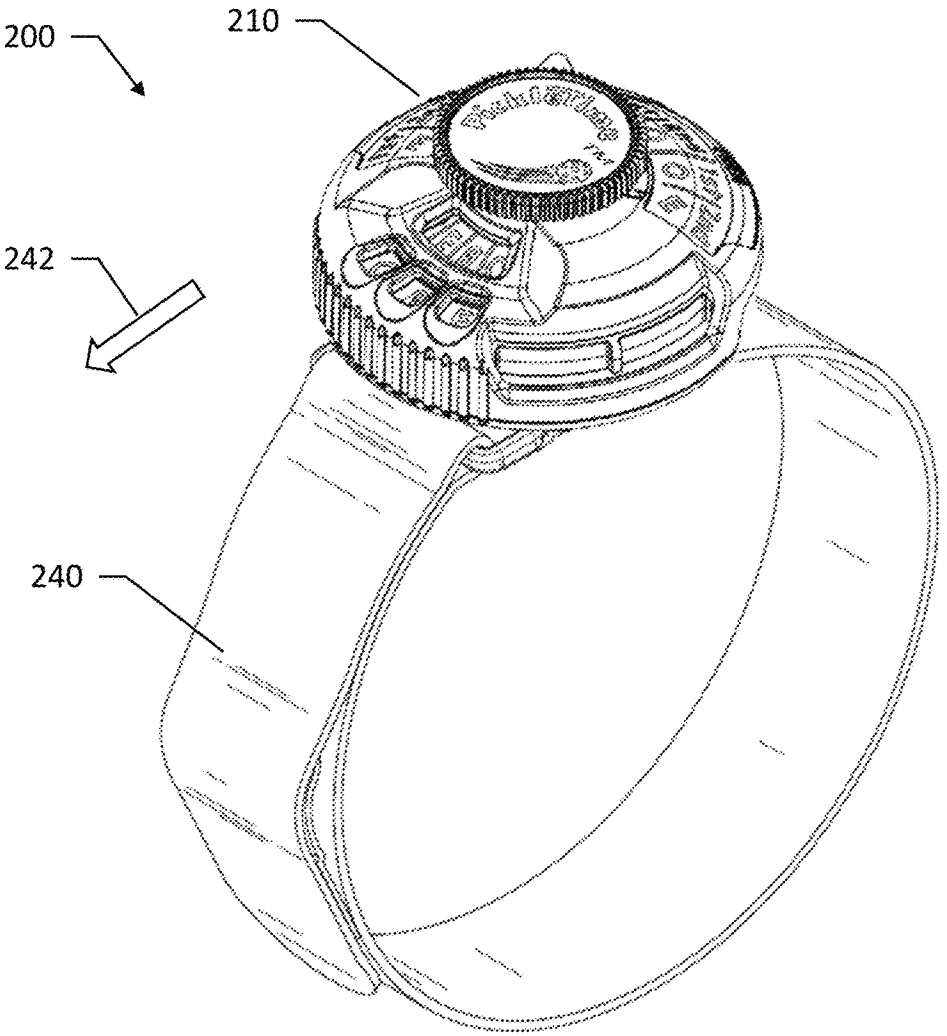
Figure 3:
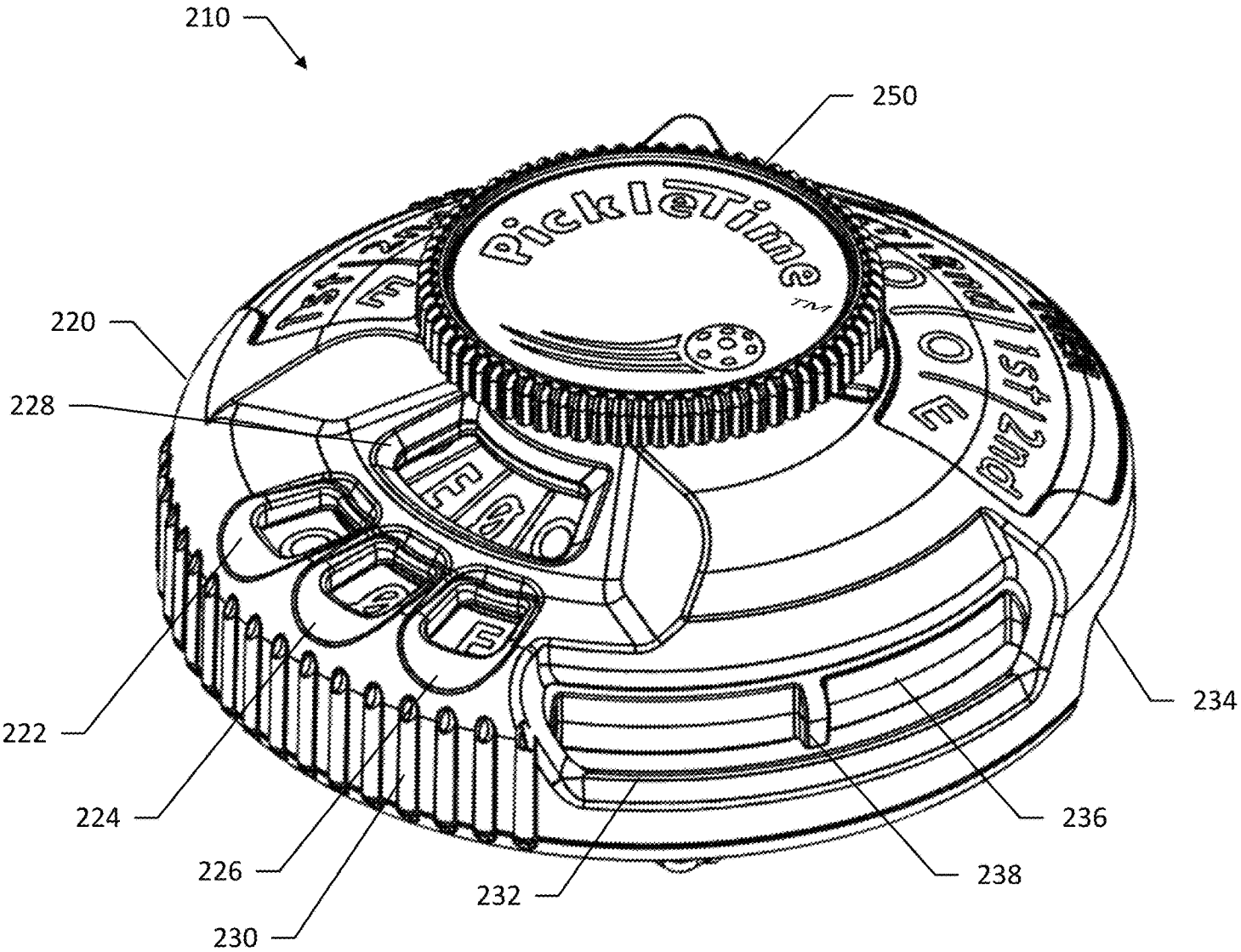
Figure 4:
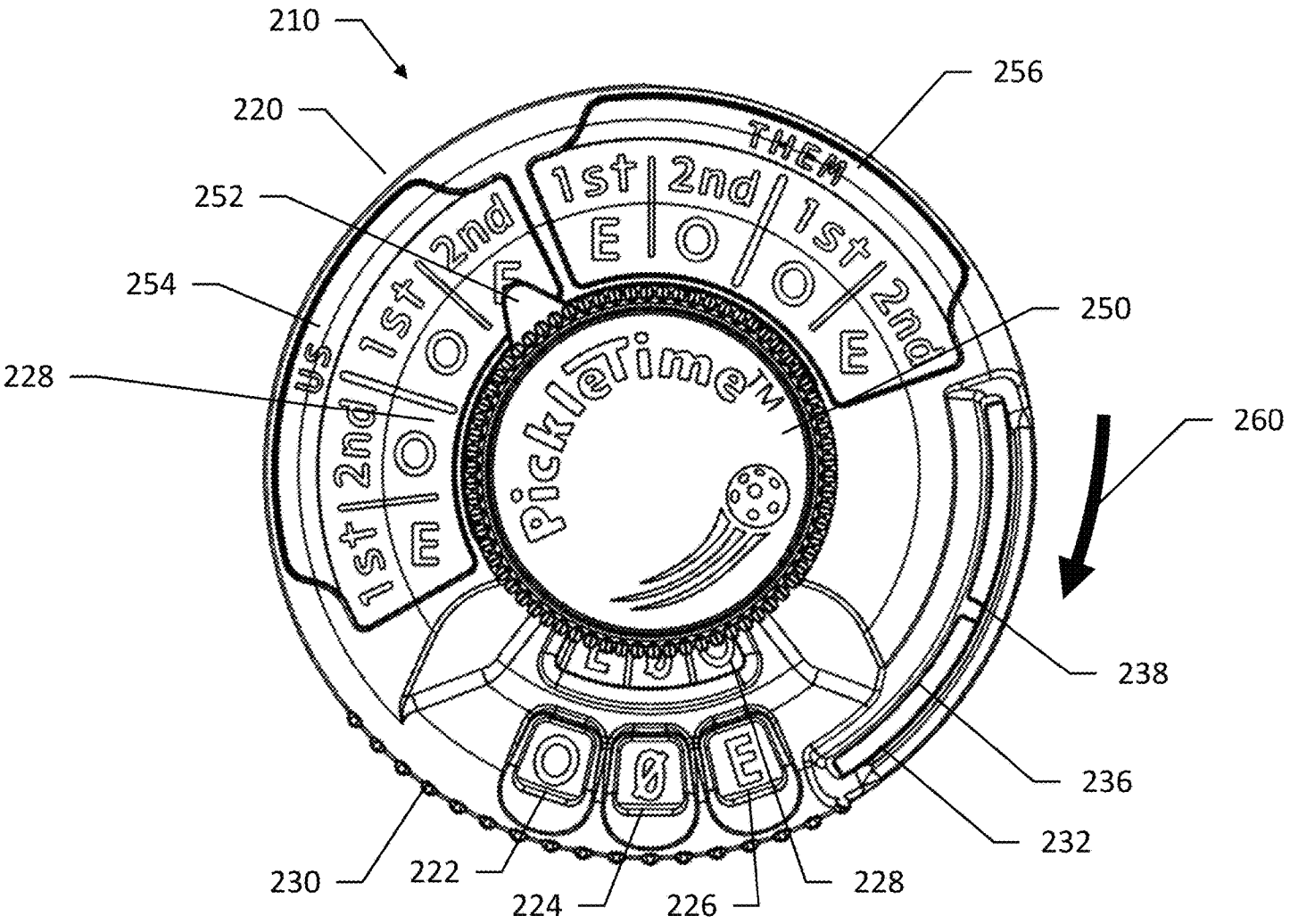
Figure 5:
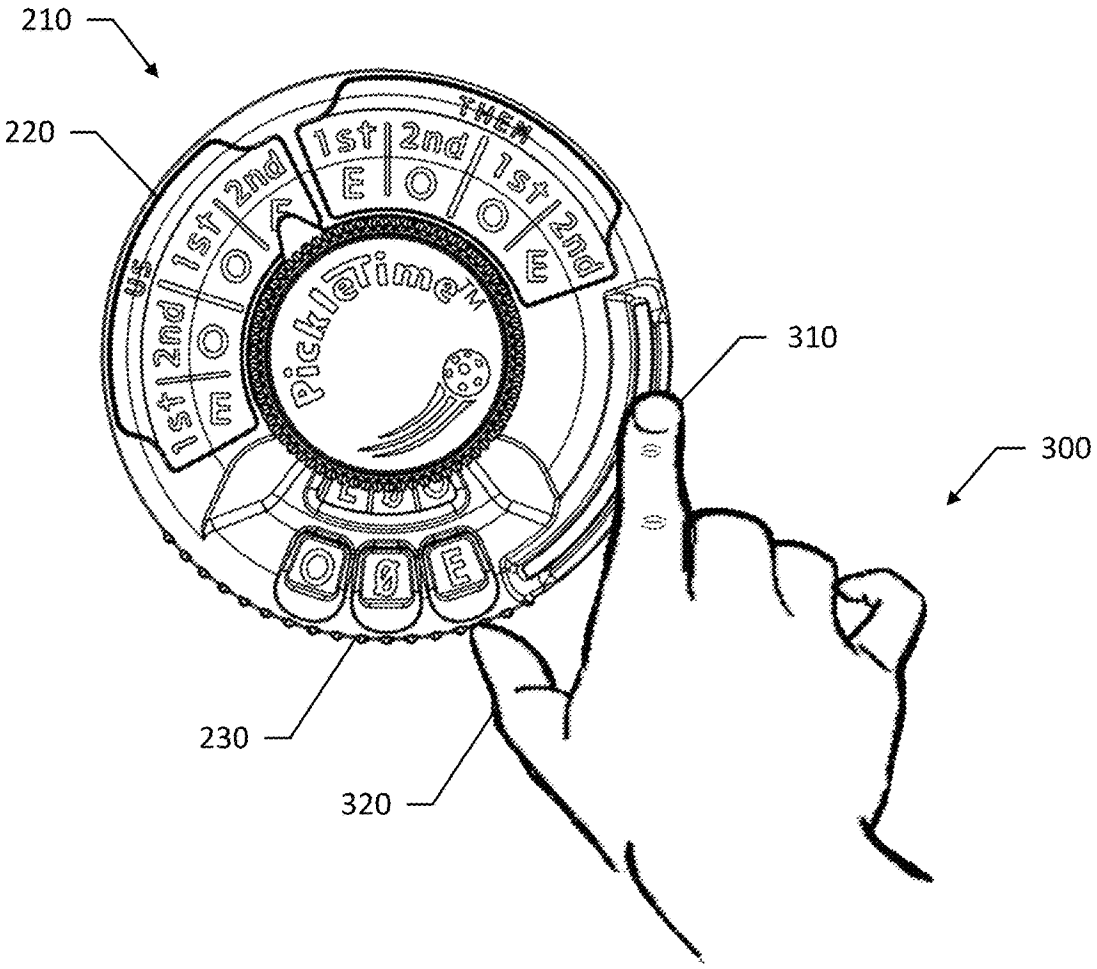
Figure 6:
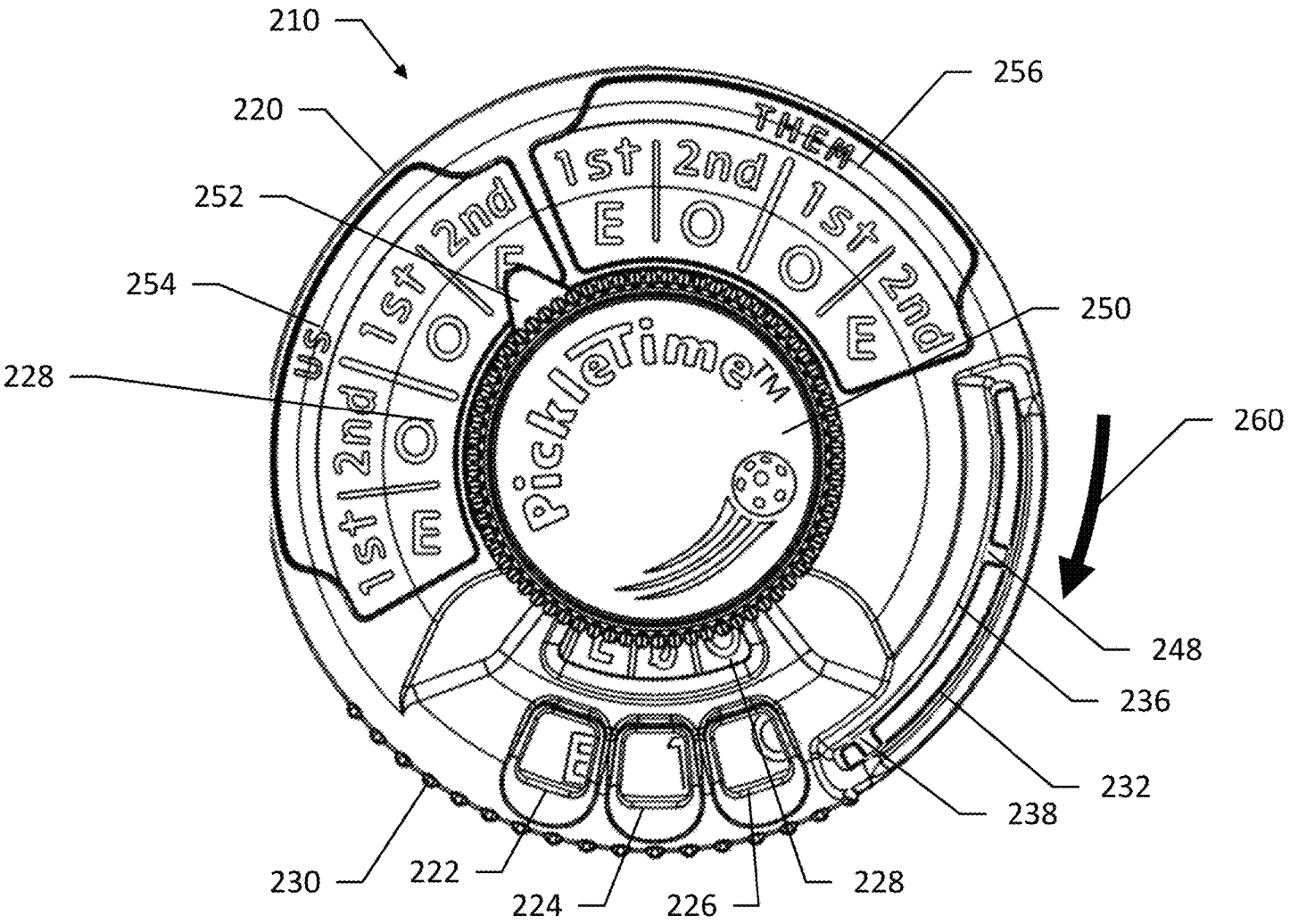
Figure 7:
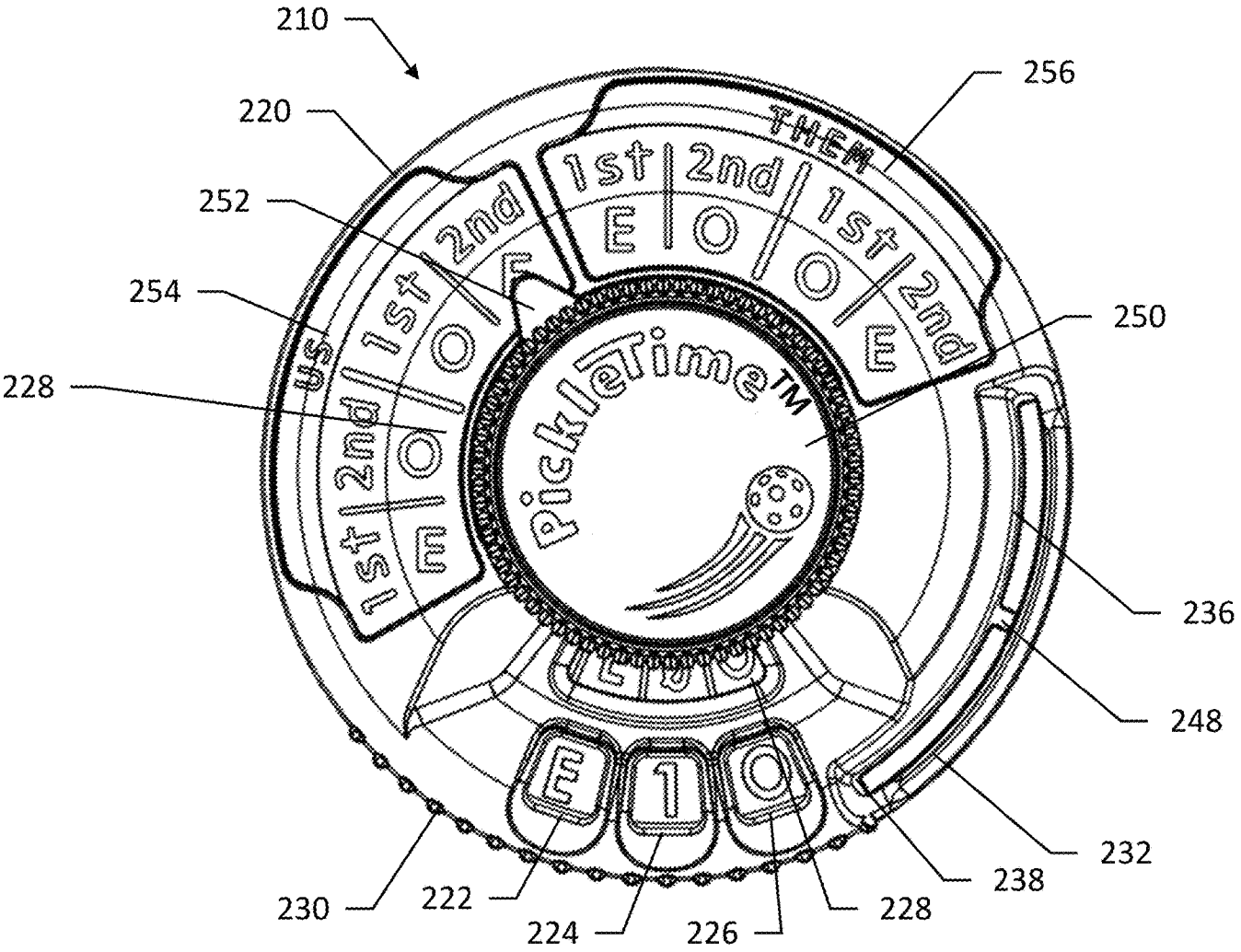
Figure 8:
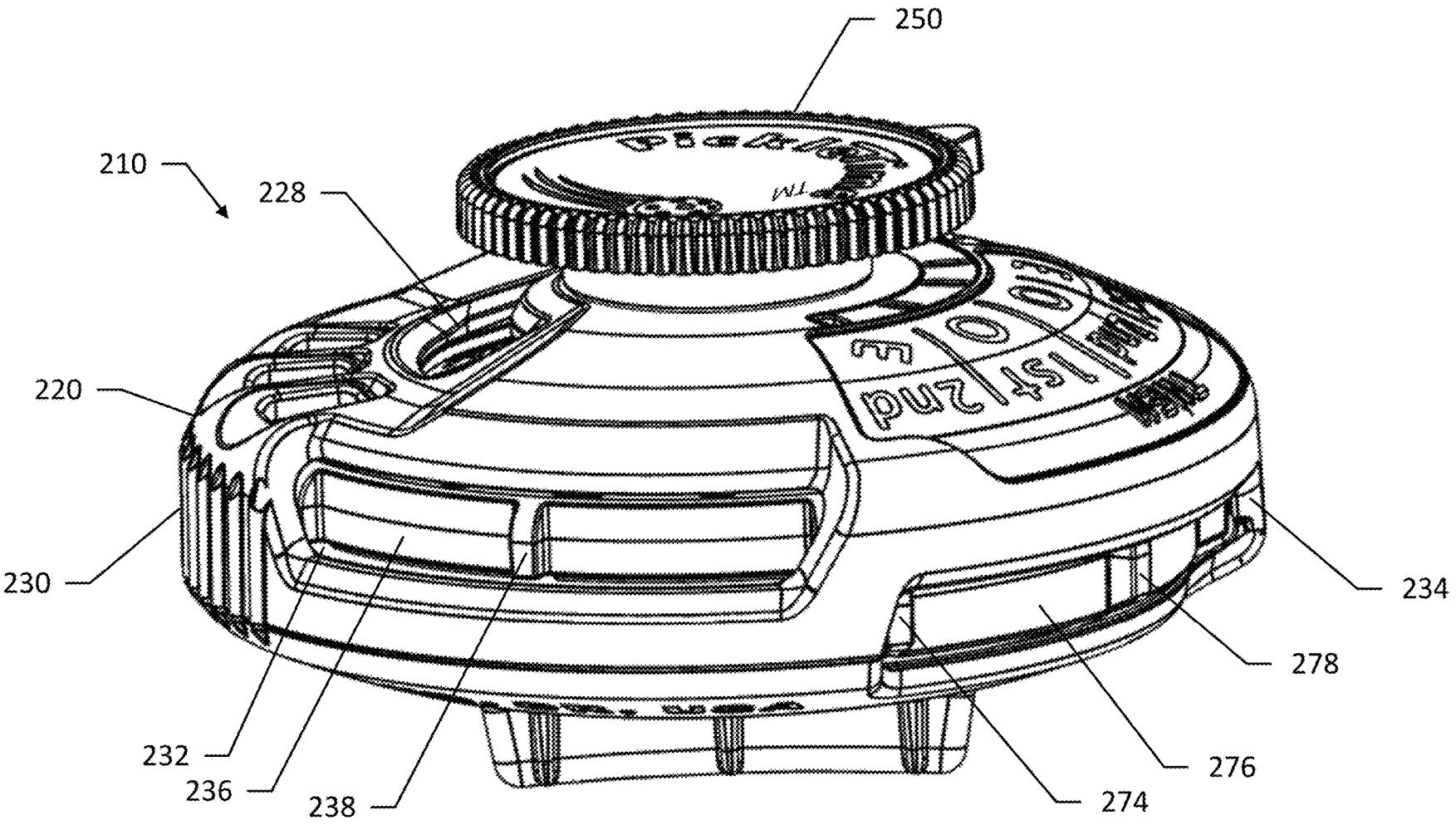
Figure 9:
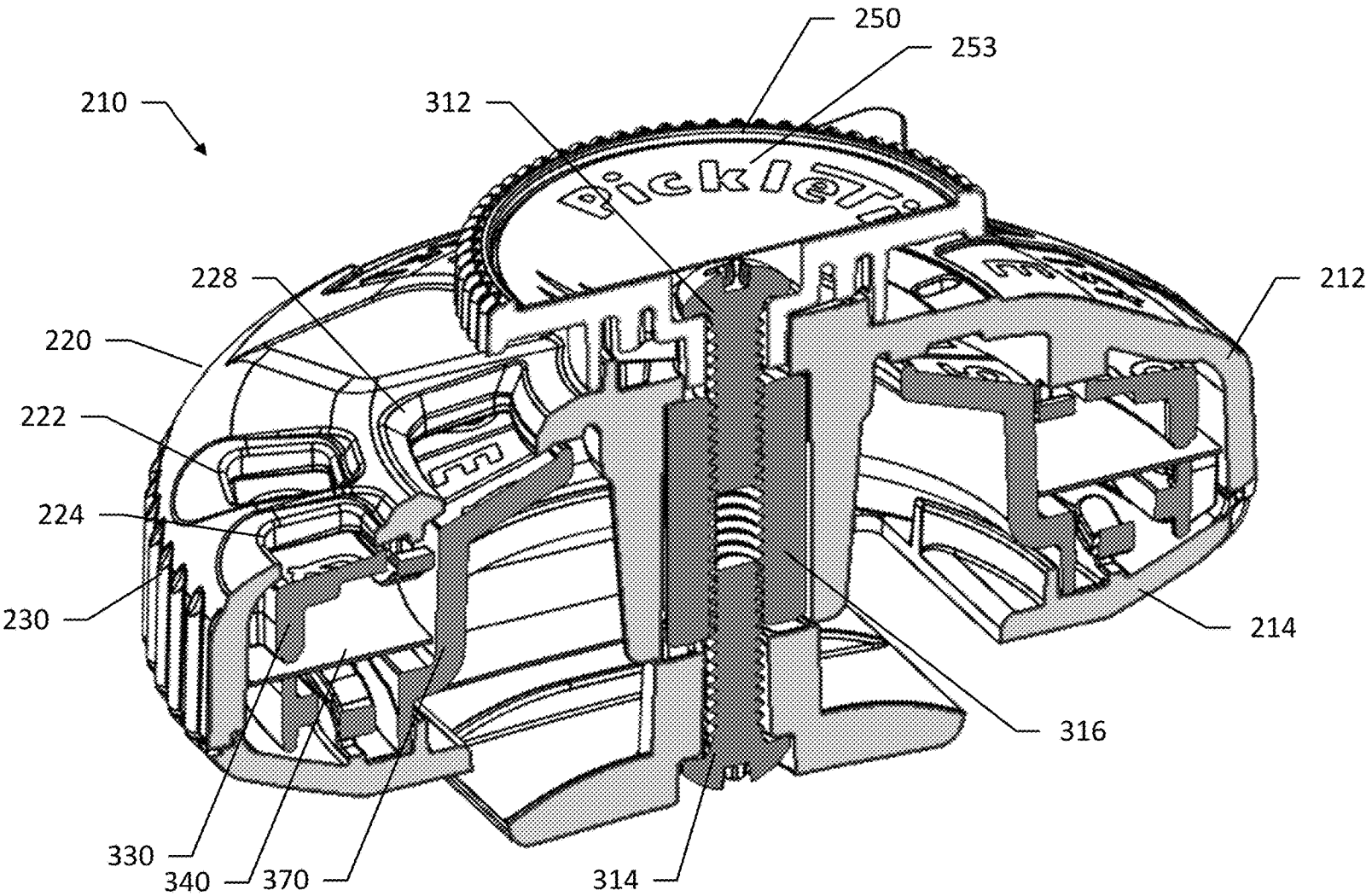
Figure 10:
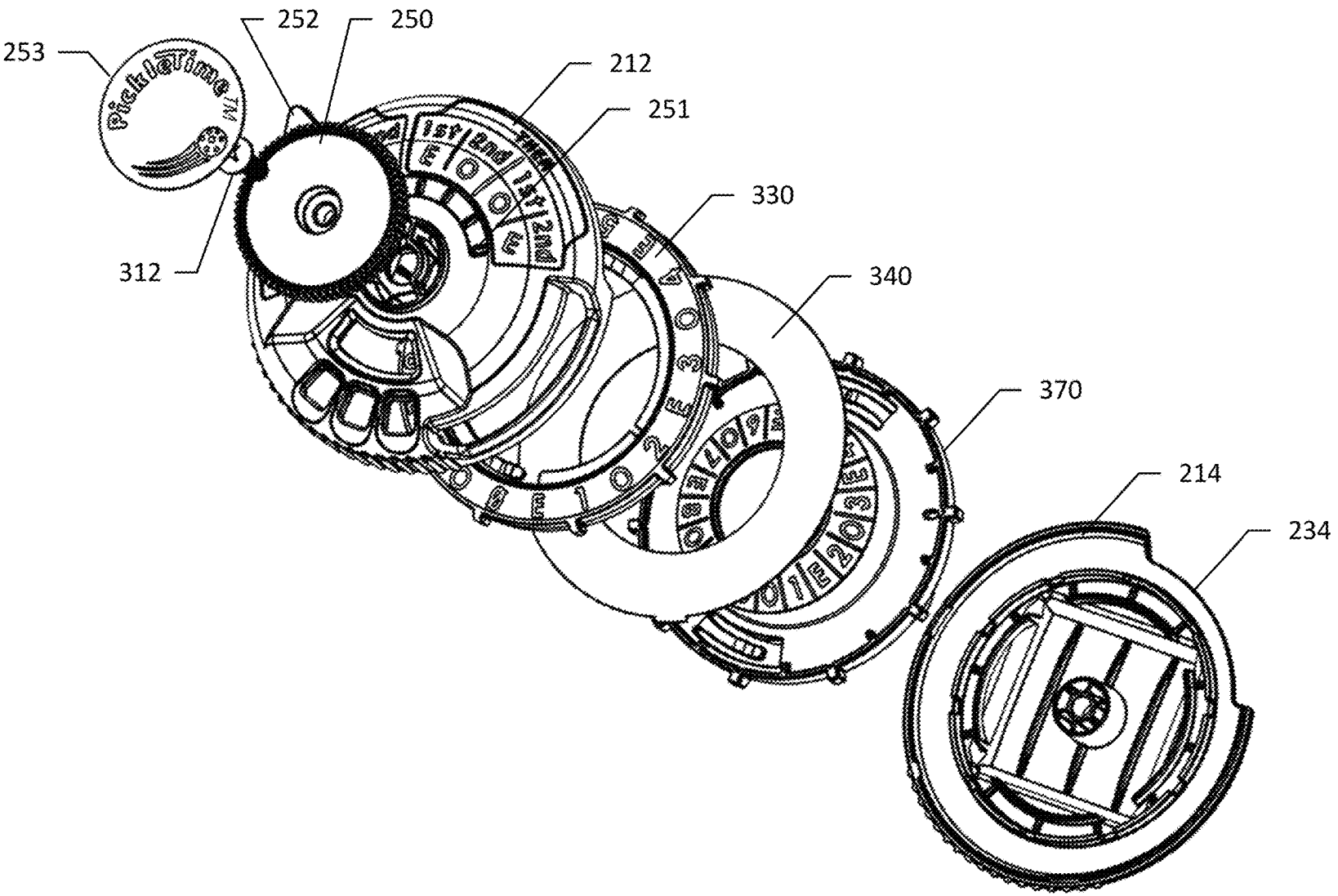
Figure 11:
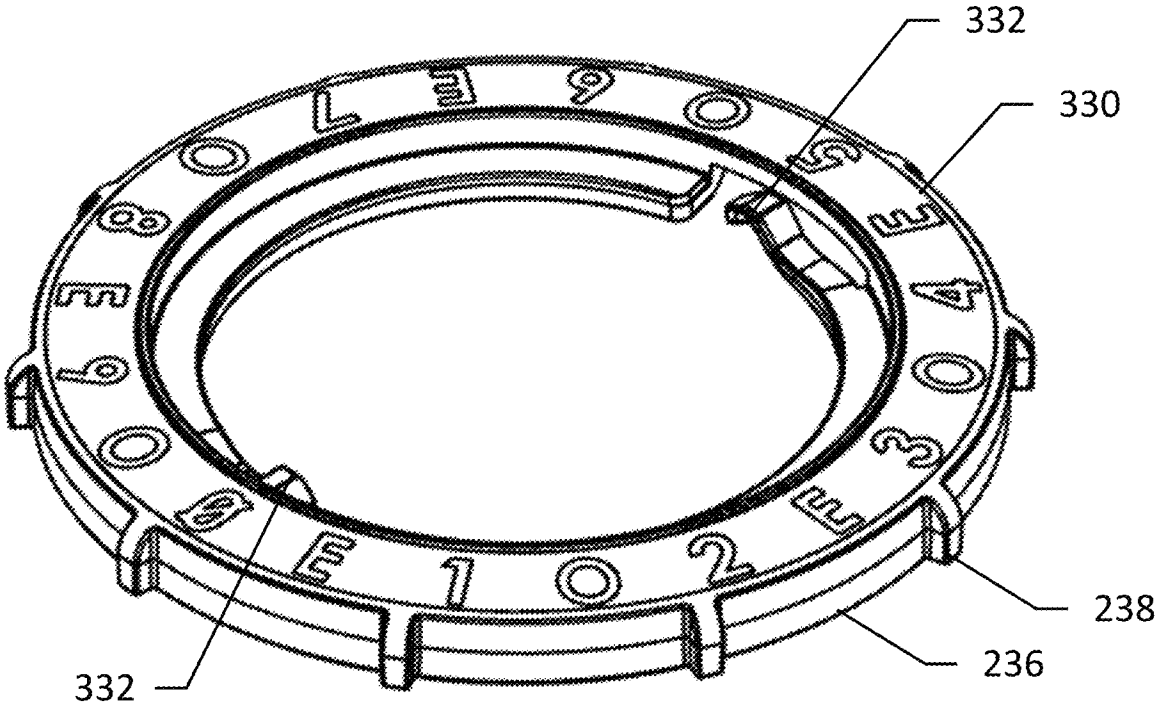
Figure 12:
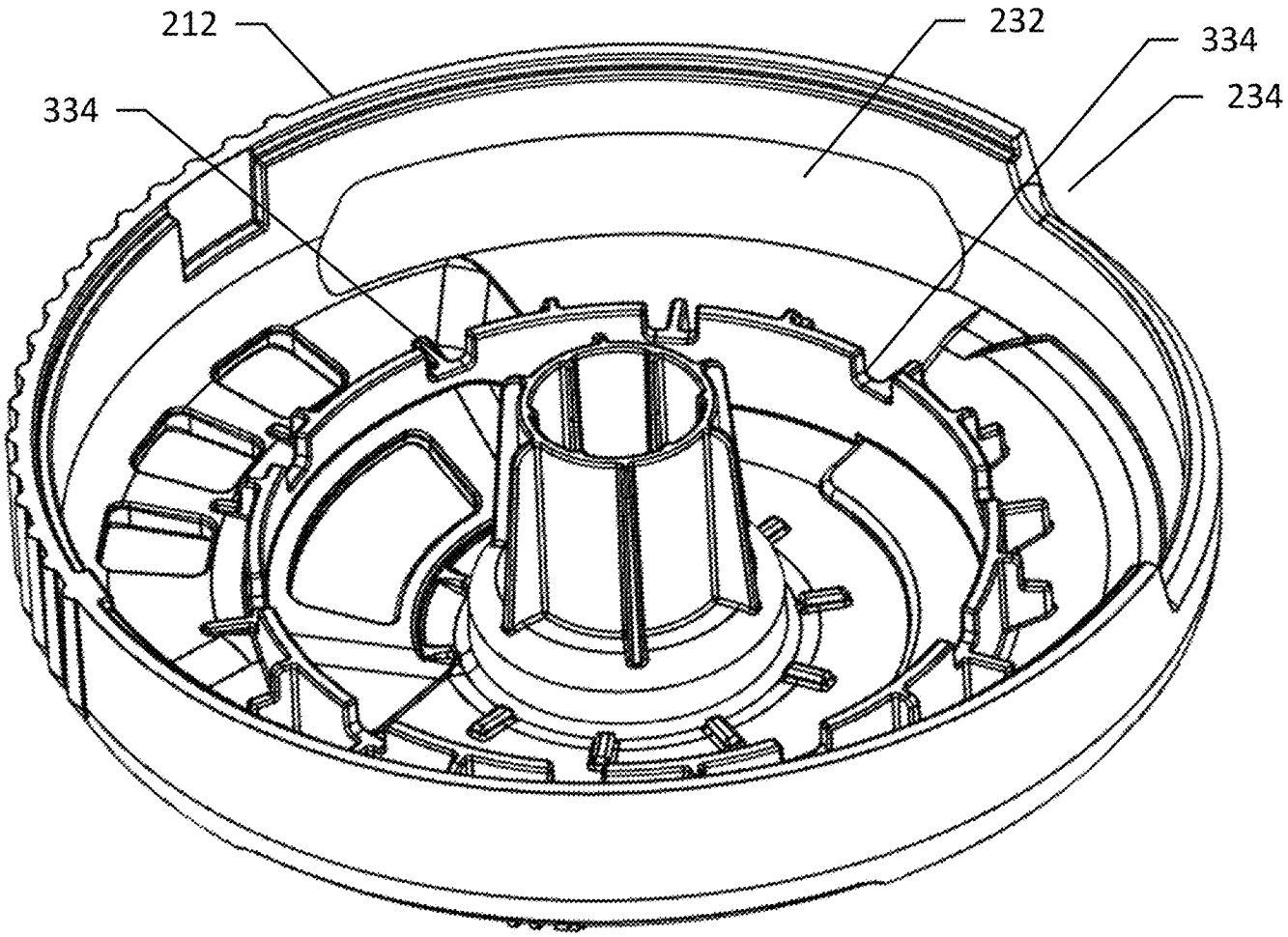
Figure 13:
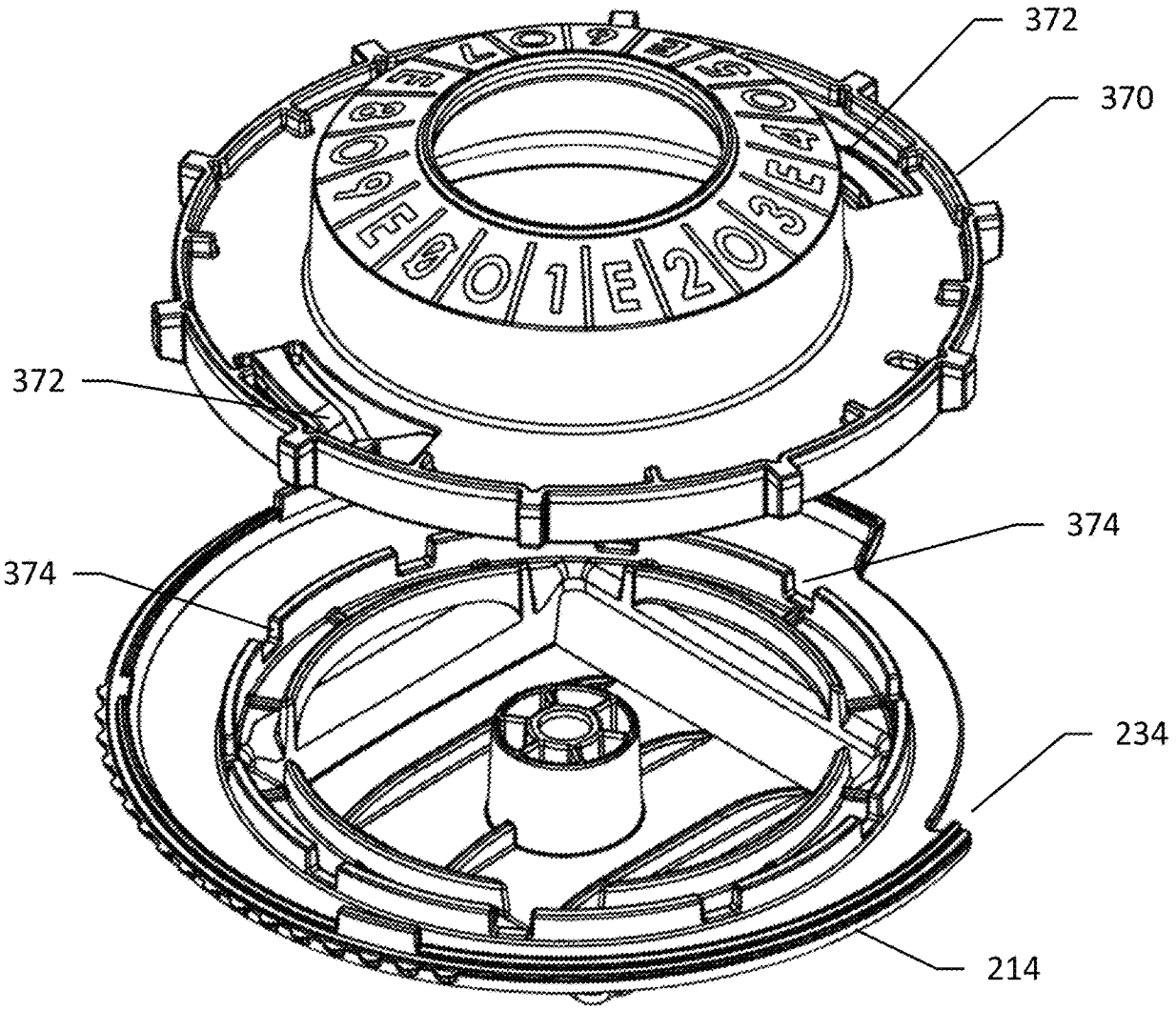
Figure 14:
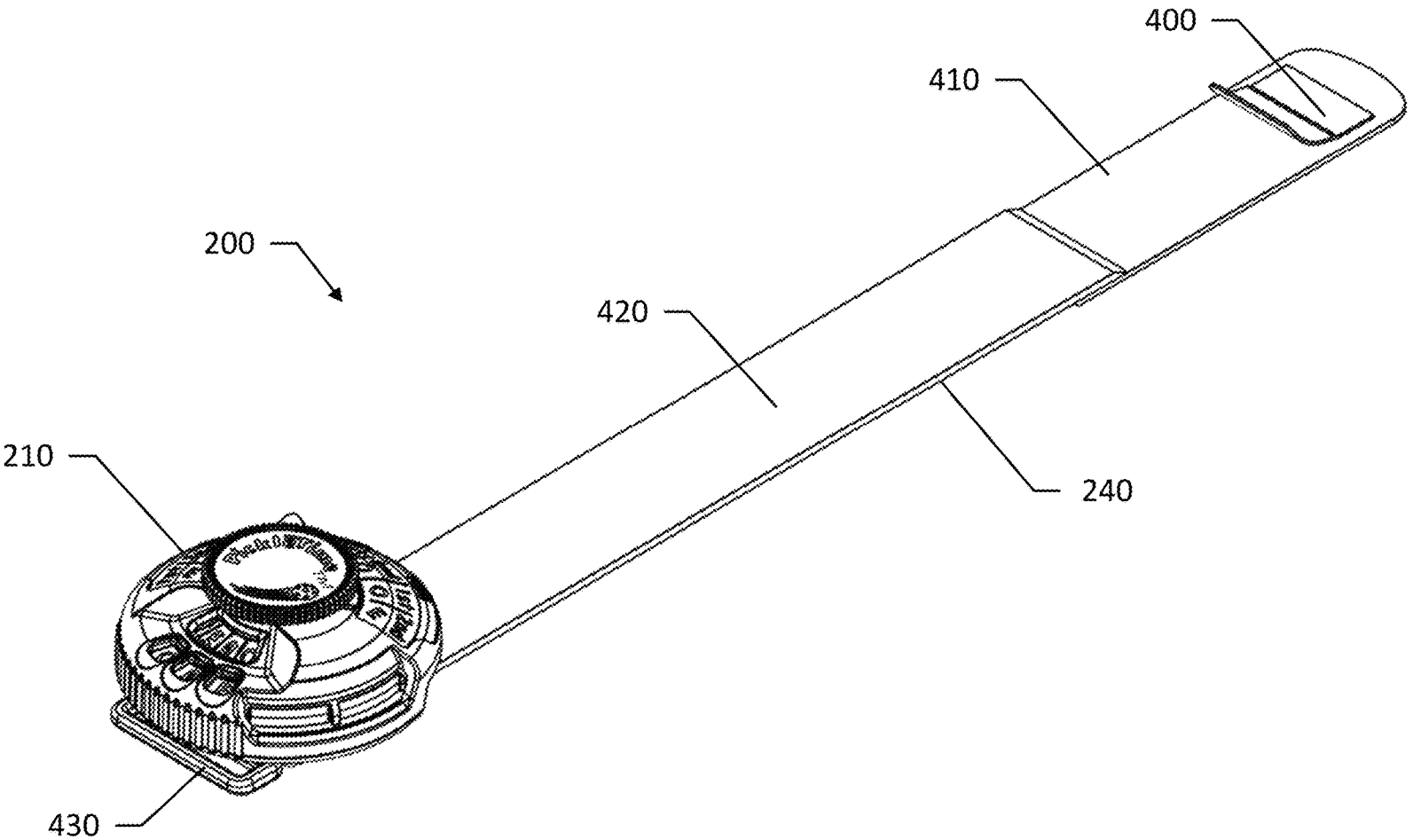
Figure 15:
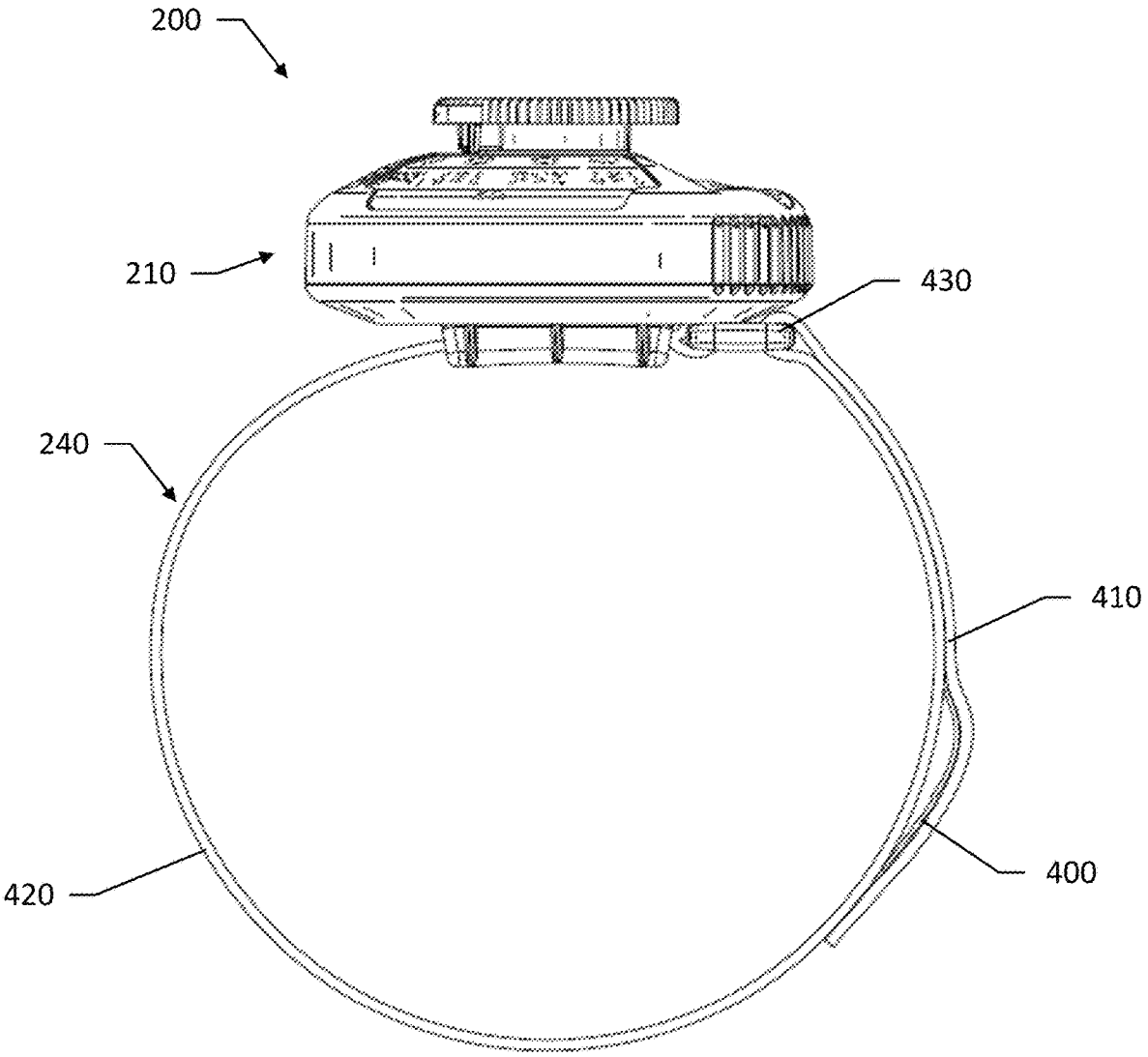
Figure 16:
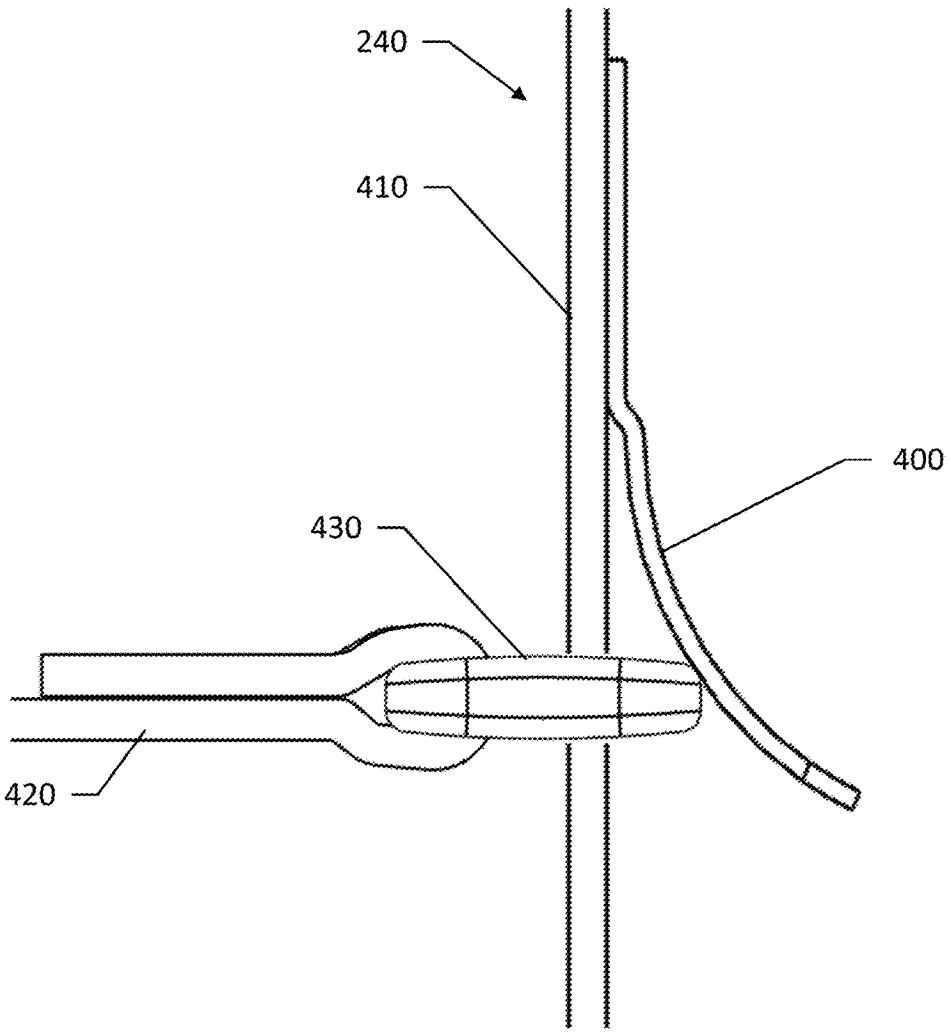

Having thus described embodiments of the invention in general terms, reference will now be made to the accompanying drawings, which are not necessarily drawn to scale, and wherein:

FIG. 1 illustrates a pickleball court according to an example embodiment of the present disclosure;

FIG. 2 illustrates a wrist worn scoring device for doubles pickleball scoring according to an example embodiment of the present disclosure;

FIG. 3 illustrates the scoring device according to an example embodiment of the present disclosure;

FIG. 4 illustrates a top view of the scoring device according to an example embodiment of the present disclosure;

FIG. 5 illustrates the scoring device being operated to advance the home team score and player positions according to an example embodiment of the present disclosure;

FIG. 6 illustrates the scoring device with the home team scoring wheel advancing according to an example embodiment of the present disclosure;

FIG. 7 illustrates the scoring device with the home team scoring wheel advanced according to an example embodiment of the present disclosure;

FIG. 8 illustrates a side view the scoring device according to an example embodiment of the present disclosure;

FIG. 9 illustrates a section view the scoring device according to an example embodiment of the present disclosure;

FIG. 10 illustrates an exploded view the scoring device according to an example embodiment of the present disclosure;

FIG. 11 illustrates the home team scoring wheel of a scoring device according to an example embodiment of the present disclosure;

FIG. 12 illustrates an underside view of the top housing of a scoring device according to an example embodiment of the present disclosure;

FIG. 13 illustrates an away team scoring wheel and the bottom housing of a scoring device according to an example embodiment of the present disclosure;

FIG. 14 illustrates a wrist worn device with the band undone according to an example embodiment of the present disclosure;

FIG. 15 illustrates the wrist worn device of FIG. 14 with the band positioned in a loop as would be worn around a wrist by a wearer according to an example embodiment of the present disclosure; and FIG. 16 illustrates a detail view of the band of the wrist worn device of FIGS. 14 and 15 with a tab of the band engaging a loop and precluding the band from passing through the loop according to an example embodiment of the present disclosure.

DETAILED DESCRIPTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Pickleball is growing in popularity with ever increasing numbers of courts to try to keep up with skyrocketing demand. While the sport is relatively easy to understand and to play, the scorekeeping of doubles play along with player positions, the server, and the server's number are more complex and require remembering scores, positions, and server information even after long rallies. The unique way in which pickleball doubles scoring is tracked makes simple tick marks or tallies unsuitable to reflect all information that is conveyed in doubles pickleball scoring.

The scorekeeper of embodiments provided herein can be used by players and/or spectators. A person viewing the match may wish to keep score for themselves or on behalf of one or more players. Embodiments described herein can be used as such provided the person using the scorekeeping device determines at the beginning of the match the home and away team. The scorekeeper can optionally be used by multiple players during the same game. This can ensure that the scores and positions are properly maintained. As noted above, keeping score can be challenging when players are focused on play, such that more than one person keeping score can be an effective way for teams to ensure the score is properly kept, and that the server calling out the score ahead of each serve correctly identifies the score and server's number.

Embodiments described herein provide a device for keeping track not only of the score of each team, but also the appropriate location of each player on the court along with who should be serving the ball and the server's number. The device of example embodiments conveys this information in an intuitive manner to the wearer and does not require the wearer to memorize any scores or positions during a game. The device described herein conveys a serving order and an indication of who is currently serving, the server's number, and a serving team's score along with a position of each member of the serving team, and a receiving team's score along with a position of each member of the receiving team. The device of example embodiments is also easy to operate and easy to understand. Only a single motion to rotate a single movable element of the device is required after each rally.

Pickleball doubles scoring is challenging to learn initially. However, using the device of embodiments described herein allows new players to quickly understand doubles scoring and how player positions change during a match. Referring now to FIG. 1 a diagram of a pickleball court 100 is depicted including a first side 110 and a second side 120 of the net 130. The first side 110 has a right service side 112 and a left service side 114, while the second side has a right service side 122 and a left service side 124. During doubles play, each player has a designated position among one of the four service sides, though only one player is the server during a point.

A player for each team is assigned to be either the "even" player or the "odd" player at the beginning of play and their position on their side of the court is determined based on their numerical score. The serving team, beginning on the first side 110 begins with their first serve of the game by the even player from the right service side 112. Upon scoring a point, the serving team players swap positions from left service side 114 to right service side 112 and vice versa, with the even player now serving from the left service side and the score is 1-0-2 (serving team score—receiving team score—service number), the "2" in the score because the first serving team begins on their second service number. The serving team, as long as they hold serve and score points, continues to swap service sides and increase their score when they win rallies. When the first serving team loses a rally, the serve moves to the other team, and they begin with their even player as the first server serving from the right service side 122 of the second side 120 of the pickleball court 100. The team now serving scores points as long as they win rallies while the first server is serving, swapping positions and changing the service position from the right side of the court to the left side of the court after each point. After losing a rally the players remain in place and the serve then switches to the team's other player (the second server) who serves until the team loses a rally, switching between right serve side and left serve side after each winning rally. After the serving team loses a rally when the second server is serving, the serving team's players stay in place and there is a "side out." The serve moves to the opposing team where each player gets to serve until losing a rally, with the players switching service sides after each point, but not after losing a rally. The game continues as described above until the winning point is scored by the serving team with a margin of two points.

As evident, this scorekeeping and keeping track of service number ($1^{st}$ or $2^{nd}$) and player positions (odd player and even player in left service side or right service side) can be challenging. Further, during long rallies or during a time out or injury time out, remembering everyone's position, the score, the server, and the server's number can be very challenging. The device of embodiments described herein solves this issue through keeping track of each of these elements with an intuitive user interface that requires minimal interaction between serves. One, and only one, of three moveable elements needs to be rotated after each rally.

FIG. 2 illustrates an example embodiment of a wrist worn device 200 where the device 210 is attached to a band 240. The arrow 242 indicates the position from which a wearer would read the wrist worn device 200 described further below.

FIG. 3 illustrates a detail view of the scorekeeping device 210 depicting the housing 220. The housing defines at least one aperture there through for viewing a score of the wearer's team, otherwise known herein as the home team, and at least one aperture through the housing for viewing a score of the opponent's team, otherwise known herein as the away team. In the illustrated embodiment, the at least one aperture for viewing the home team's score includes three apertures including left aperture 222, center aperture 224, and right aperture 226. The at least one aperture for viewing the away team's score includes a single aperture 228. Either of the at least one aperture for viewing the home team's score or away team's score can include a single aperture, as shown as aperture 228 in FIG. 3, or more than one aperture as shown as apertures 222, 224, and 226 in FIG. 3 without deviating from the functionality of the device 210 described herein.

Visible through the at least one aperture for viewing the home team's score are the home team's score visible in middle aperture 224, while a position indicator for the right service side (112 in FIG. 1) is visible in right aperture 226 to the right of the score in middle aperture 224. A position indicator for the left service side (114 in FIG. 1) is visible through the left aperture 222. In the illustrated embodiment, the position indicators reference the "odd" player as "O" and the "even" player of the same team as "E". Visible through the apertures for the home team's score and positions in the illustrated embodiment of FIG. 3 reads "O" "0" "E," indicating the odd player position is in the left service side while the even player is positioned in the right service side and the team has a score of zero.

Visible through the at least one aperture for viewing the away team's score is the away team's score and player positions visible in single aperture 228. As shown, the score and player positions read "E" "0" "O" signifying that the even player on the opposing team is positioned on the right service side (122 in FIG. 1) and the odd player is positioned on the left service side (124 in FIG. 1). This is how a wearer would see the opposing team across the net such that the layout of player positions on the apertures shown on the device of the wearer is the same as how the wearer is seeing the proper player positions on the court. The away team's score is also shown as zero such that the scores and positions are indicative of the beginning of a match.

The housing 220 further includes knurling 230 about a portion of the perimeter of the housing in a position that would be facing a wearer when they read the device 210. The housing defines a home team score opening 232 and an away team score opening 234 which is more clearly illustrated in later figures. Within the home team score opening 232 is visible a periphery of a home team scoring wheel 236 which includes protrusions 238. Atop the housing 220 is a serving knob 250 which is detailed further below.

FIG. 4 illustrates a top view of the device 210 showing the housing 220 including the left aperture 222, middle aperture 224, and right aperture 226 along with a slightly less visible single aperture 228. Of note, when worn on the wrist of a wearer the single aperture 228 is generally more visible as the view of the wearer is not typically from directly above the device 210. Also visible are the knurling 230 of the housing and home team score opening 232 and the periphery of the home team scoring wheel 236. The operation and function of the serving knob 250 is more visible with the scoring knob including pointer 252. The housing 220 includes two serving order displays including the "us" serving order display 254 and the "them" serving order display 256. The "us" serving order display 254 reflects the home team serving order while the "them" serving order display 256 reflects the away team serving order. The terms "home team" and "away team" as used herein are in reference only to reflect a wearer of the device and not indicative of who may hold first serve in a match. Detents hold the pointer 252 in place at each serve position as further described below. The detents provide sufficient resistance to ensure that during play the pointer 252 does not inadvertently move during play while still being easily moved by a wearer to another serve position with an intentional rotation.

There are four segments for each serving order display. As shown, these include "$1^{st}$ E", "$2^{nd}$ O", "$1^{st}$ O", and "$2^{nd}$ E". The serving knob is rotated whenever a serving team loses a rally. When the score at side out is even, according to the rules of pickleball, the first server for the team is the even player, so the pointer points to $1^{st}$ E. After the team loses a rally with the even player serving first, the pointer is moved to $2^{nd}$ O and the odd player on the team serves. When the score at side out is odd, according to the rules of pickleball, the first server for the team is the odd player, so the pointer points to $1^{st}$ O. After the team lose a rally with the odd player serving first, the pointer is moved to $2^{nd}$ E and the even player on the team serves. After a team loses a rally with the second server serving, a "side out" has occurred and the pointer is moved to the appropriate segment for the other team.

The serving player's identification information on the housing 220 informs the serving player where to position herself on the court to serve by looking for her corresponding identification information in the aperture. For example, if the even player is serving, the even player looks in the aperture to see where the even player should be standing—the right service side or the left service side—and serves from that side. The wearer can also check that when the away team is serving, the correct player is serving from the correct service side.

The periphery of the home team scoring wheel 236 is visible through opening 232. The home team score is advanced using the home team scoring wheel by turning the wheel in a clockwise direction shown by arrow 260. To do this, a wearer uses a finger, preferably the fingernail of the finger, such as their index finger of the hand not wearing the device 210, to contact the periphery of the home team scoring wheel 236 at protrusion 238 and advance the wheel in the clockwise direction of arrow 260. The knurling 230 aids this movement by providing a place where a wearer's thumb can be placed on the housing 220 to steady the hand and provide leverage to the hand that is advancing the home team scoring wheel. As explained in detail below, the opening 232 is dimensioned to stop the wearer's fingernail at the next score.

FIG. 5 illustrates an example embodiment of the hand 300 of a wearer being used to advance the home team score of the device 210. Notably, the device 210 and hand 300 are not to scale relative to one another, and the illustration of FIG. 5 merely depicts the engagement and movement of the wearer's hand 300 and the device 210. As shown, a thumb 320 of the wearer can be placed at the knurling 230, while the index finger 310 of the same hand 300 contacts the protrusion 238 of the periphery of the home team scoring wheel 236 to advance the home team score.

FIG. 6 illustrates the protrusion 238 of the periphery of the home team scoring wheel 236 rotated almost to the end of the opening 232. As shown, the score and player positions within the home team scoring apertures including the left aperture 222, middle aperture 224, and right aperture 226 are advancing but not yet aligned with the apertures. A next protrusion 248 becomes visible within the opening 232 as the home team scoring wheel is rotated. FIG. 7 illustrates when the score has been successfully advanced by one point. As shown, the protrusion 238 that had been pushed to advance the score has been moved to just past the opening 232 with the next protrusion 248 positioned in an accessible position within the opening 232 ready to advance the home team scoring wheel again when appropriate and when moved by the wearer.

The score and player positions have also been updated within the apertures of the device 210 of FIG. 7. The left aperture 222 went from an "O" signifying the odd player in the left service side to an "E" signifying the even player moves to the left service side. The home team score in the middle aperture 224 now indicates a score of one point. The right aperture 226 advanced from an "E" signifying the even player in the right service side to an "O" signifying the odd player now belongs in the right service side. The home team scoring wheel also includes protrusions and corresponding detents of the housing such that the home team scoring wheel is secured in position when the player positions and score are properly aligned within the apertures as will be further detailed below.

FIG. 8 illustrates another view of the device 210 depicting the housing 220 with the knurling 230 that would face a wearer as the device is read and operated. The illustrated view of the right side of the device includes the opening 232 through which the periphery of the home team scoring wheel 236 is visible. Also shown on a lower side of the housing is another opening 234 through which the periphery of the away team scoring wheel 276 is visible. This scoring wheel includes a first protrusion 274 and a second protrusion 278 visible through the opening 234.

The away team scoring wheel functions in a manner very similar to the home team scoring wheel. However, when the home team scoring wheel advances, only the score and player positions for the home team are shown in the home team score apertures (left aperture 222, middle aperture 224, and right aperture 226), and when the away team scoring wheel advances, only the score and player positions for the away team are shown in the away team score and player position single aperture 228. The score and player positions shown in the away team score and player position single aperture 228 advance incrementally in response to a wearer moving the second protrusion 278 to the position in which the first protrusion 274 is shown. This movement alters the player positions and the score of the away team by one point for each movement of the second protrusion 278 to the position of the first protrusion 274.

The home team score opening 232 and the away team score opening 234 are sized, and the protrusions positioned such that precise actuation to advance one scoring wheel or the other is achieved even without precise care taken by the wearer. As there is one protrusion positioned proximate a middle of each respective aperture when the scores and positions are aligned within their respective apertures, that is the only protrusion for each scoring wheel that is accessible to a wearer. That wearer can then advance the respective scoring wheel in the clockwise direction by pushing the protrusion to the end of the respective opening. The scoring wheels both employ projections and detents to align the scores and player positions within the score apertures, and the position of the respective protrusion just at the end of the respective opening aligns with these projections and detents. Because of these features, advancing the score for either the home team or the away team is a quick process that accurately and repeatably centers the next score in the sequence within the score apertures without requiring precision input or substantial focus from the wearer, since the wearer may be concentrating on playing the game, thereby not wanting to focus attention on the scoring device 210.

FIG. 9 illustrates a section view of the device 210 taken down a middle of the device through the middle aperture 224. As shown, the housing 220 is formed of two parts, the top housing 212 and the bottom housing 214. The housing 220 forms a cavity therein, within which is the away scoring wheel 370 and the home scoring wheel 330. The away scoring wheel 370 and home scoring wheel 330 are separated by disc 340 which aids smooth rotation of one scoring wheel relative to the other and assures that the scoring wheels rotate independently of each other. The away scoring wheel 370 is visible through aperture 228, while the home scoring wheel is visible through the left aperture 222 and middle aperture 224, along with the right aperture 226 (not shown in FIG. 9). As shown, the home team scoring wheel 330 is relatively flatter as it is manually advanced through the cavity in the top housing 212. The away scoring wheel 370 is taller and is also manually advanced through the cavity in the bottom housing 220. An inner section of the away team scoring wheel 370 extends up through a center of the home team scoring wheel 330. Both the away team scoring wheel 370 and the home team scoring wheel 330 are coaxial in the illustrated embodiment. Further, the serving knob is also coaxial with the scoring wheels and each turns about the same axis independently of each other to change the information presented by each element.

The top housing 212 and bottom housing 214 are held together through a central axis by a top screw 312 and a bottom screw 314 engaging a threaded element 316 which is held rotationally fixed within a bore of the top housing 212. The serving knob 250 is secured to the top housing 212 by the top screw 312. In the illustrated embodiment, a graphic sticker 253 is placed over the screw hole through the serving knob 250 for appearance and branding.

FIG. 10 illustrates an exploded view of the scoring device illustrating the assembled order. As shown, the bottom housing 214 is at a bottom of the device with opening 234 for accessing and advancing the away team scoring wheel 370. The disc 340 is shown between the away team scoring wheel 370 and the home team scoring wheel 330. The top housing 212 covers the scoring wheels and receives the serving knob 250. The top screw 312 engages the threaded element 316 (not shown in FIG. 10) and the bottom screw 314 (not shown in FIG. 10) to secure the assembly together and the graphic sticker 253 covers the top screw 312 for aesthetics. Also visible in FIG. 10 are detents 251 in the top housing 212. These detents 251 are configured to receive therein a protrusion on an underside of the pointer 252 such that the pointer 252 aligns with each server information segment and is held in a set position until a user advances the serving knob 250 to the next server information segment.

While the example embodiments described above and illustrated reflect a manner of assembly and packaging that uses a single axis of rotation for each of the home team scoring wheel 330, away team scoring wheel 370, and serving knob 250, embodiments can alternatively have one or more of these elements rotatable on a different axis while retaining the ability to present the score, player positions, serving team, serving player, and the serving player's number.

FIG. 11 illustrates the home team scoring wheel 330 including the plurality of numbers and characters. As shown, the numbers are shown ranging from zero to nine, separated by alternating "O" and "E". This unique configuration of characters provides the functionality described above with respect to the display of the score and the player positions through the left aperture 222, middle aperture 224, and right aperture 226. The home team scoring wheel 330 also includes projections 332. The projections are used in combination with detents within the top housing 212 to define positions where the score and player positions are properly aligned with the apertures depicting the home team score.

FIG. 12 illustrates an underside view of the top housing 212 including the opening 232 for advancing the home team score and player positions and a portion of the opening 234 for advancing the away team score and player positions. Also shown are detents 334 which are engaged by the projections 332 of the home team scoring wheel to define the ten positions of the home team scoring wheel that align the scores and player positions with the score and player position apertures.

FIG. 13 illustrates the away team scoring wheel 370 that includes a sequence of numbers separated by characters similar to the arrangement of the home team scoring wheel. However, the character order is reversed. While the home team scoring wheel 330 begins with "O 0 E", the away team scoring wheel begins with "E 0 O". This reflects the appropriate positions of the players at the start of a game from the perspective of the wearer. The away team scoring wheel 370 also includes projections 372. The projections are configured to engage detents 374 in the bottom housing 214 that includes a portion of the opening through which the away team score is advanced. The detents 374 are engaged by the projections 337 of the away team scoring wheel to define the ten positions of the home team scoring wheel that align the scores and player positions with the score and player position aperture.

While detents and projections are described above for positive alignment of the pointer 252 with the server information and for aligning player positions and scores within the one or more apertures, embodiments can optionally employ frictional engagement of a scoring wheel or the server information indicator separate from or in addition to the detent operation.

Embodiments of the scoring device described herein provide an intuitive way to keep track of who is to be serving, the home team score, the away team score, the home team court positions, and the away team court positions during doubles pickleball. Further, the device requires input to only one element after each rally. At the end of each rally, there are several possible outcomes. If a serving team wins the rally and the serving team is the device wearer's team, the home team scoring wheel 330 is advanced one increment. This increases the home team score by one point and changes the court positions of the home team players. If the non-serving team wins the rally regardless of which team it is, neither scoring wheel is moved, but the serving knob 250 is moved to the next server. If the serving team is the away team, and the away team wins a rally, the away team scoring wheel 370 is moved to advance the away team's score by one while changing the player positions on the court for the away team. If a mistake is made on which scoring wheel is moved, the mistake can be easily corrected by moving the scoring wheel in the opposite direction. Likewise, the serving knob can be easily moved to the correct location.

As the device described herein provides all relevant scoring and position information for doubles pickleball and requires only one and exactly one movement of one of the home team scoring wheel, the away team scoring wheel, or the serving knob, the device is intuitive and tracks nine pieces of information with minimal input. Those nine pieces of information include: home team score, away team score, home team even player position, home team odd player position, away team even player position, away team odd player position, serving team, serving player (odd or even), and whether it is a team's first serving player or second serving player. Regardless of how long a rally lasts, if there is an injury or other timeout, forgetfulness, or other distraction during a match, the device described herein retains all relevant information to continue play without further interruption or debate.

The wrist worn device 200 shown in FIG. 2 is illustrated in FIG. 14 with the band 240 undone. The band 240 of the illustrated embodiment includes a hook-and-loop fastener type closure, with a first portion 410 of the band having a hooked surface on the side showing in FIG. 14, and the second portion 420 having a looped surface on the side showing. The band 240 is wrapped through loop 430 and the hooked surface of the first portion 410 is secured to the looped surface of the second portion 420 as shown in FIG. 2 and in another view in FIG. 15. Also illustrated in FIG. 14 is a tab 400. The tab 400 is attached to the first portion.

When the band 240 is inserted through the loop 430, the first portion 410 of the band can fold back around the loop to attach to the second portion 420. The length of band pulled through the loop before attachment of the first portion 410 to the second portion 420 determines a size and is adjusted based on a wrist around which the device is worn. Also shown in FIG. 15 is the tab 400 which is sandwiched between the first portion 410 and the second portion. This tab serves to prevent the band from inadvertently being removed from the loop 430 when the first portion 410 is not attached to the second portion 420. The band 240 is generally loosened by unfastening the first portion 410 from the second portion 420 and the band size increased to accommodate a wearer's hand as the band 240 is put on or taken off a wrist. In doing so, without the tab 400, the band 240 could be pulled through the loop 430.

FIG. 16 illustrates how the first portion 410 of the band 240, as it is pulled through the loop 430, is stopped from being pulled entirely through as the tab 400 engages the crosspiece of the loop 430. The tab may be made of a somewhat flexible material, such as a thin plastic, where the tab 400 cannot be pulled through the loop without substantial force, beyond what is necessary to take on or off the band 240 from a wrist. However, the tab 400 is sufficiently flexible to be pressed toward the first portion 410 of the band 240 to fit through the loop 430 if the first portion is to be intentionally removed from the 430. The tab 400 prevents unintentional removal of the first portion 410 of the band 240 from through the loop 430.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed is:

1. A doubles pickleball scoring device comprising:

a housing defining at least one first aperture and at least one second aperture;

a first scoring wheel disposed within the housing and rotatable about a first axis; and a second scoring wheel disposed within the housing and rotatable about the first axis;

wherein a portion of the first scoring wheel is displayed within the at least one first aperture and a portion of the second scoring wheel is displayed within the at least one second aperture, wherein the portion of the first scoring wheel displayed within the at least one first aperture comprises an indication of a position and score of a first doubles team, wherein the portion of the second scoring wheel displayed within the at least one second aperture comprises an indication of a position and score of a second doubles team.

2. The doubles pickleball scoring device of claim 1, wherein the first doubles team comprises a first player and a second player, wherein the first scoring wheel includes a first identifier for the first player, and a second identifier for the second player, wherein the portion of the first scoring wheel displayed within the at least one first aperture comprises an indication of a relative position on a pickleball court of the first player and the second player.

3. The doubles pickleball scoring device of claim 2, wherein the second doubles team comprises a third player and a fourth player, wherein the second scoring wheel includes a third identifier for the third player, and a fourth identifier for the fourth player, wherein the portion of the second scoring wheel displayed within the at least one second aperture comprises an indication of a relative position on a pickleball court of the third player and the fourth player.

4. The doubles pickleball scoring device of claim 3, wherein the score of the second doubles team is indicated on the portion of the second scoring wheel displayed within the at least one second aperture between the third identifier and the fourth identifier.

5. The doubles pickleball scoring device of claim 2, wherein the score of the first doubles team is indicated on the portion of the first scoring wheel displayed within the at least one first aperture between the first identifier and the second identifier.

6. The doubles pickleball scoring device of claim 1, further comprising a wrist strap attached to the housing.

7. The doubles pickleball scoring device of claim 1, further comprising a dial indicator, wherein the dial indicator is rotatable about the first axis, and wherein the dial indicator points to indicia on the housing identifying a serving player of the first doubles team or a serving player of the second doubles team.

8. The doubles pickleball scoring device of claim 7, wherein the indicia on the housing further identifies a server's number of the first doubles team or a server's number of the second doubles team.

9. The doubles pickleball scoring device of claim 1, wherein the housing defines a first opening and a second opening, wherein a portion of a periphery of the first scoring wheel is accessible to a user through the first opening, wherein a portion of a periphery of the second scoring wheel is accessible to the user through the second opening.

10. The doubles pickleball scoring device of claim 9, wherein the portion of the periphery of the first scoring wheel defines a first gripping element, wherein the first scoring wheel is configured to advance in response to the user moving the first gripping element within the first opening, wherein the portion of the periphery of the second scoring wheel defines a second gripping element, wherein the second scoring wheel is configured to advance in response to the user moving the second gripping element within the second opening.

11. The doubles pickleball scoring device of claim 10, wherein the housing comprises a plurality of detents, wherein the first scoring wheel comprises at least one raised element, wherein in response to the user moving the first gripping element within the first opening, the at least one raised element of the first scoring wheel is advanced from a first detent to a second detent.

12. The doubles pickleball scoring device of claim 11, wherein the at least one raised element of the first scoring wheel at the first detent defines a location displaying a player position and score of the first doubles team in the at least one first aperture, and wherein the at least one raised element of the first scoring wheel at the second detent defines a location displaying a next player position and score of the first doubles team in a scoring sequence in the at least one first aperture.

13. The doubles pickleball scoring device of claim 12, wherein the housing comprises a second plurality of detents, wherein the second scoring wheel comprises at least one raised element, wherein in response to the user moving the second gripping element within the second opening, the at least one raised element of the second scoring wheel is advanced from a first detent of the second plurality of detents to a second detent of the second plurality of detents.

14. The doubles pickleball scoring device of claim 13, wherein the at least one raised element of the second scoring wheel at the first detent defines a location displaying a player position and score of the second doubles team in the at least one second aperture, and wherein the at least one raised element of the second scoring wheel at the second detent defines a location displaying a next player position and score of the second doubles team in a scoring sequence in the at least one second aperture.

15. A doubles pickleball scoring device comprising:

a housing defining at least one first aperture, at least one second aperture, and a cavity;

a first scoring wheel disposed within the cavity, wherein a portion of the first scoring wheel is visible through the at least one first aperture; and a second scoring wheel disposed within the cavity, wherein a portion of the second scoring wheel is visible through the at least one second aperture, wherein the portion of the first scoring wheel displayed within the at least one first aperture comprises an indication of a position and score of a first doubles team, and wherein the portion of the second scoring wheel displayed within the at least one second aperture comprises an indication of a position and score of a second doubles team.

16. The doubles pickleball scoring device of claim 15, wherein in response to advancing the first scoring wheel, the position and the score of the first doubles team advance concurrently.

17. The doubles pickleball scoring device of claim 16, wherein in response to advancing the second scoring wheel, the position and the score of the second doubles team advance concurrently.

18. The doubles pickleball scoring device of claim 15, further comprising indicia on an outside surface of the housing and a pointer, wherein the indicia reflect a serving person and a serving person's number of a player of the first doubles team and a serving person and a serving person's number of a play of the second doubles team, wherein the pointer indicates a current serving person and the current serving person's number.

19. The doubles pickleball scoring device of claim 18, wherein the pointer comprises a pointer wheel rotatable about a first axis.

20. The doubles pickleball scoring device of claim 15, further comprising a wrist strap attached to the housing.

21. The doubles pickleball scoring device of claim 15, wherein the first scoring wheel comprises a sequence of characters, wherein the sequence of characters comprises a sequence of numbers from zero to at least nine, with a first alphabetical character following each even number and a second alphabetical character following each odd number.

22. The doubles pickleball scoring device of claim 21, wherein the second scoring wheel comprises a second sequence of characters, wherein the second sequence of characters comprises a sequence of numbers from zero to at least nine, with the first alphabetical character following each odd number and the second alphabetical character following each even number.

23. A method of scoring doubles pickleball comprising:

rotating a first scoring wheel within a housing to advance a score and player positions for a first doubles team;

rotating a second scoring wheel within the housing to advance a score and player positions for a second doubles team; and concurrently displaying the score and the player positions for the first doubles team and the score and the player positions for the second doubles team.

24. The method of claim 23, further comprising:

rotating a dial indicator on the housing among indicia to indicate a server of the first doubles team or a server of the second doubles team.

25. The method of claim 24, wherein the indicia on the housing further identifies a server's number of the first doubles team or a server's number of the second doubles team.

* * * * *